US005452849A

United States Patent [19]

Schramer et al.

[11] Patent Number: 5,452,849

[45] Date of Patent: Sep. 26, 1995

[54] EASY OPEN TAB SEALER FOR PACKAGES

[75] Inventors: Kurt M. Schramer, Stow, Ohio; David A. Morris, Edina, Minn.

[73] Assignee: Morgan Adhesives Co., Stow, Ohio

[21] Appl. No.: 3,449

[22] Filed: Jan. 12, 1993

Related U.S. Application Data

[63] Continuation-in-part of Ser. No. 196,374, May 19, 1988, abandoned.

[51] Int. Cl.[6] ..... B65D 5/70

[52] U.S. Cl. ..... 229/206; 220/270; 229/125.01; 229/125.09

[58] Field of Search ..... 220/258, 260, 220/269, 270, 359; 229/125.01, 125.04, 125.08, 125.09, 125.15, 125.17, 125.18, 125.19, 200, 206, 238, 245, 247, 248, 249

[56] References Cited

U.S. PATENT DOCUMENTS

| | | | |
|---|---|---|---|
| 3,711,011 | 1/1973 | Kugler | 383/203 |
| 3,977,591 | 8/1976 | Martensson et al. | 229/125.09 |
| 4,595,116 | 6/1986 | Carlsson | 220/359 |
| 4,705,197 | 11/1987 | Gordon et al. | 229/123.3 |
| 4,792,069 | 12/1988 | Nantin et al. | 222/527 |
| 4,798,296 | 1/1989 | Lagerstedt et al. | 229/229 |

FOREIGN PATENT DOCUMENTS 0205073 12/1986 European Pat. Off. .

*Primary Examiner*—Moy M. Joseph
*Attorney, Agent, or Firm*—Oldham, Oldham & Wilson Co.

[57] ABSTRACT

A method and apparatus for a pull tab opening mechanism utilized in container systems for easy opening and convenient manufacturing. The method and apparatus therefor comprising a base paper stock in which a pour hole is die cut. The paper stock being laminated with layers of aluminum foil and polyethylene which cover the die cut pour hole. A pull tab system adhered to the top of the laminated structure advantageously provides an opening mechanism which does not compromise the integrity of the container and is easily manufactured.

7 Claims, 2 Drawing Sheets

EASY OPEN TAB SEALER FOR PACKAGES

This is a continuation-in-part of application Ser. No. 07/196,374 filed on May 19, 1988, now abandoned.

FIELD OF THE INVENTION

This invention relates to a container closure assembly for use on liquid or dry product containers having a preformed opening in one end thereof. More particularly, this invention provides an improved pull tab opening system for containers that permits the clean opening of the container without compromising the integrity of the container contents. The invention is especially suitable for aseptic containers but may be used with non-aseptic containers as well.

BACKGROUND OF THE INVENTION

Tape closure assemblies for containers are known which utilize two or three-tape closure systems for a pour hole in the container end. Such systems include the combination of an interior tape covering the pour hole on the inner side of the container end, an exterior tape which covers the pour hole on the exterior surface of the container, and a pull tab extending over a portion of the exterior tape to facilitate grasping the tape and opening the container.

For paper containers or cartons, the method generally used in assembling such a system includes providing a base paper stock which is coated with a polyethylene or similar extruded coating on its outer surface. An aluminum foil is laminated to the back side or inner surface of the paper stock, and a further polyethylene or similar material is extruded over the foil to thereby make the container impermeable to liquid contents. The structure provides the finished web stock for the cartons or containers which is then slit into individual widths and utilized as roll stock material. Such roll stock may be further finished to basic individual sheet stock depending on the next step of the process. Typically, a straw hole or pour hole may be then punched through the entire laminate structure which then must be covered by a closure assembly.

A container constructed in this manner is then ready to enter the first stage of the filling process once a suitable easy opening closure assembly is adhered over the die cut pour hole. A pressure sensitive or heat activated peel open single-faced tape is applied to the top of the carton stock over the die cut pour opening. Since the adhesive on the tape and the edge of the pour hole are exposed to the fill material where the die cut hole is, a second tape must be applied to the underside of the exterior tape to act as a barrier to the contents of the container. A grip tab tape may then be further applied to the exterior tape to provide an area for easy grasping and activation of the pull tab.

The carton stock is then ready to proceed to the actual filling operation to finish the process. Two such systems which have previously been employed are disclosed in U.S. Pat. No. 4,445,620, issued May 1, 1984, to Brochman, et al., and U.S. Pat. No. 4,163,506, issued Aug. 7, 1979, to Patterson. These patents employ the basic two-tape system, and may incorporate a third tape as described above for the pull tab operation. These patents further incorporate additional structure such as a flexible tear template being bonded to the interior and exterior tapes of the closure system, or an alternate means for forming a grip or pull tab and hold-down means therefore.

Such closure systems have more recently been utilized in aseptic container systems wherein the base paper stock, as described above, is used instead of aluminum cans or the like. In aseptic systems, it is important that the closure system does not compromise the integrity of the container contents. For this reason, the second tape or barrier tape as described above has been utilized. In such an aseptic container, it has been found that the edges of the barrier tape or interior tape that are exposed to the fill material may still compromise the integrity of the container. Because of the exposed edges, fill material containing orange or fruite juices, and oils having an acidic base, cannot be used with this system, as the oils will tend to attack the exposed edges and the adhesive thereon to compromise the system. This is true especially when using pressure sensitive type tape systems.

Another problem found with the closure system described is that normally the paper stock is sheet fed in order to apply the interior and exterior tapes of the closure system. By manufacturing the container in this manner, the production is relatively slow and restricts the feed rate of the filling operation.

The two or three-tape closure system also must use additional materials, and includes the additional steps to apply the separate tapes during assembly which increase the cost of such a system. The present invention provides a tape closure system which overcomes the deficiencies of the prior art, and forms an easily opened yet simplified and effective closure system which is particularly advantageous for use in aseptic container systems, but may be used in non-aseptic applications.

SUMMARY OF THE INVENTION

It is an object of the present invention to provide a simplified opening assembly for aseptic containers, which will improve the closure characteristics and manufacturing process of the assembly with the container.

It is a further object of the present invention to provide a one tape opening assembly which is reliable in its use and leaves an unobstructed, clean the pour hole in the container upon removal of the tape.

It is an additional object of the present invention to provide an opening assembly which does not compromise the integrity of the container as compared to other aseptic systems, and thereby maintains the sterility of an aseptically packaged product during manufacturing, filling, distribution, transportation and handling.

It is still a further object of the present invention to provide a closure assembly that offers resistance to tampering, and may be reclosable for short term storage once the container is opened.

It is a further object of the present invention to provide a pull tab closure system in which a gripping area is directly produced in the one tape closure system, thereby eliminating the need for additional materials or steps in the manufacturing process.

The method and apparatus for applying the pull tab, and forming the opening system of the present invention are provided to make a greatly simplified system for more efficient manufacturing, and greater reliability. In a preferred embodiment, the present invention comprises a hand operable, easy opening pull tab system particularly usable in aseptic containers having a multi-laminated structure of aseptic materials with barrier properties to maintain sterility. In such containers, a base paper stock is provided which is coated with a layer of polymeric material on the outer surface thereof. A pour hole or preformed opening is then die cut in one end thereof. An uninterrupted layer of polymeric material is then extruded on the backside of the paper stock and covers the preformed opening or pour hole. An uninterrupted layer of aluminum foil or similar material is laminated to the backside of the polymeric layer, and again covers the pour hole cut in the paper stock. A finished web stock is produced by extruding a polymeric aterial over the foil again providing another uninterrupted layer covering the pour hole on the inner side thereof to thereby effectively seal the entire container including at the location of the die cut pour hole. The finished stock is then slit into individual widths utilized as roll stock material for the manufacturing and filling processes. The use of roll stock is preferred because it reduces processing steps and costs, but sheet stock could be used.

The pull tab or opening mechanism is then ready to be applied to the finished container stock, and comprises a single tape having a pressure sensitive and/or heat activated adhesive to be applied to the top of the carton stock over the pour hole. It is noted that since the adhesive on the tape and the edge of the pour hole are not exposed to the fill material where the preformed die cut hole is located, a second tape does not have to be applied to the underside of the pour hole to act as a barrier. This system does not compromise the integrity of the carton stock due to a completely uninterrupted film barrier of the polymeric/foil/polymeric multi-laminated structure over the pour hole.

The adhesion between the pull tab of the opening mechanism and the construction of the opening mechanism at the locations of the pour hole is such that when the pull tab is activated, the aseptic barrier layers are ruptured without delaminating, thereby leaving a clean hole the same shape as the die cut hole originally cut in the sealed base paper stock. It is also noted that the apparatus provided to apply the pull tab system of the present invention is utilized to fold over the edge of the pull tab tape wherein an adhesive to adhesive bond is formed to provide a gripping tab for opening. The apparatus also comprises pressing and heating dies used in the application of the pull tab which could result in weakening of the aseptic barrier layers at the location of the pour hole, to insure a proper operation of the opening pull tab mechanism when applied. With the present invention, it has been found that the resulting assembly is significantly simpler along with being more cost effective and reliable than previous attempts found in the prior art.

BRIEF DESCRIPTION OF THE DRAWINGS

For an understanding of the scope of the invention and a complete understanding of the objects, techniques, and structure of the invention, reference should be made to the following detailed description and the accompanying drawings wherein.

DETAILED DESCRIPTION OF THE INVENTION

Figure 1:
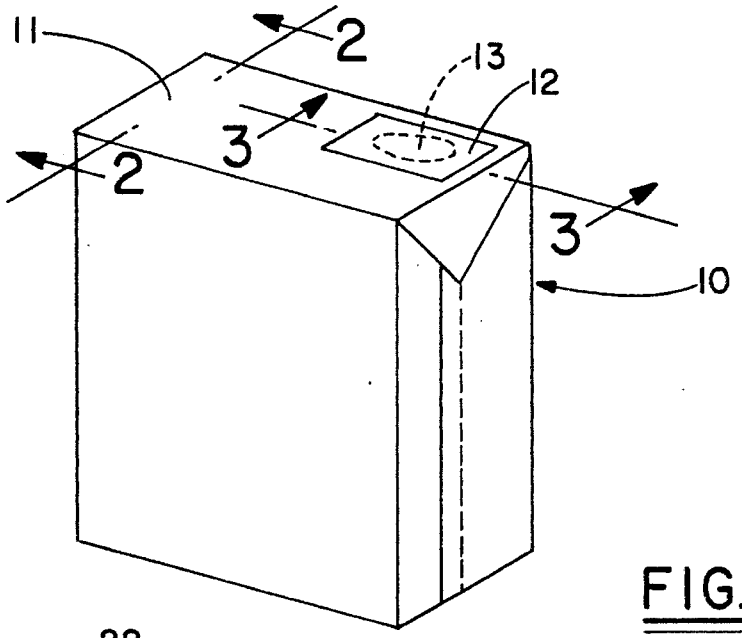
FIG. 1 is a perspective view of an aseptic container having a pull tab opening mechanism.

For a complete understanding of the scope of the preferred embodiments of the invention, reference is made to FIGS. 1–9 showing the preferred embodiments of the present invention. Referring now to FIG. 1, there is shown a container 10 which may be of the aseptic variety for liquids such as juices and non-carbonated beverages or other liquid or dry products. Aseptics has become significant in packaging such products as it is very cost effective and gives extended shelf-life to the product. New trends in the aseptic packaging market are related to easy opening features such as a straw hole in which a straw is provided with the container. The provision of a straw packaged with the container inhibits vending of the containers from vending machines and adds cost to the product. It has also been found that the use of a straw is not well accepted by the adult community, and accidents or spillage may easily occur from gripping the container and forcing the contents through the small hole provided. Therefore, alternative or additional easy opening features are desirable for gulpability of the liquid product, or to be used with high viscosity products.

The container 10 is formed of a multi-laminated structure 11, and shows the addition of an easy opening pull tab feature 12 which covers the preformed opening or pour hole 13. The pull tab feature associated with such packages should have certain characteristics such that it can be easily opened without the use of a tool, and when removed forms a good spout with a clean pouring lip so that the contents may be poured without spilling or consumed directly from the container. A critical feature of such an opening system is that its addition does not effect the containers' integrity during manufacture, filling, distribution, transportation or handling. It is the primary concern in aseptic packaging to maintain the sterility of the product in order to obtain the extended shelf life of the product. Another feature of the easy opening system may be a reclosability feature.

Some problems encountered with the addition of the easy opening feature have been compromise of the container integrity due to improper sealing of the pour hole 13 by the pull tab 12. Also, during manufacture, the application of the pull tab has created a problem in that the speed of the pull tab filling equipment utilized is limited by the speed of the pull tab application.

Figure 2:
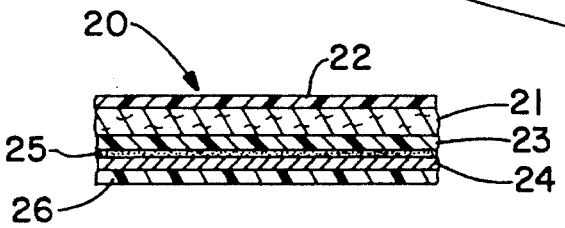
FIG. 2 is an enlarged cross-sectional view of the multi-laminated container structure taken along the line 2—2 of FIG. 1.

Referring now to FIG. 2, which shows the multi-laminated structure of the aseptic container 10. A finished web stock 20 comprises a base paper stock 21 which usually has product information printed thereon. The base paper stock 21 is then coated with a layer of polyethylene or similar material 22 on the outer surface thereof to seal the paper stock 21. Similarly, a layer of polyethylene or similar material 23 is extruded onto the backside or inner surface of the base paper stock 21. Thereafter, a layer 24 of aluminum foil or similar material such as metalized polyester is laminated onto the backside of the base paper stock over the polyethylene layer 23 by means of a suitable adhesive 25. It is noted that another material may be used in place of the foil 24 to enable the container to be utilized in microwave ovens. At this point a polyethylene or similar material is then extruded over the foil at 26 to produce the finished web stock. Additional laminations may be provided or taken away, such as the polyethylene layer 23 between the base paper stock and the aluminum foil as desired for a particular use. The multi-laminated structure provides barrier properties which in conjunction with aseptic processing give the desired aseptic properties.

Figure 3:
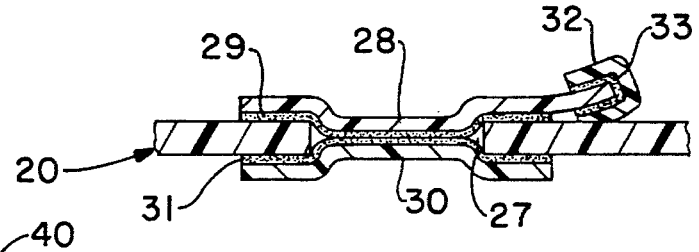
FIG.-3 Prior Art
FIG. 3 is an enlarged cross-sectional view of a prior art pull tab opening mechanism that has been used with the container of FIG. 1, and taken along the line 3—3.

An easy opening pull tab feature as is found in the prior art is shown in FIG. 3. This system has been developed by the 3-M Company and comprises a three tape closure system. As seen in FIG. 3, the finished web stock 20 as shown in FIG. 2 is provided with a preformed opening or pour hole 27 which is die cut through the entire multi-laminated structure 20. A top tape 28 is then provided, which may be a metalized polyester or similar material. The top tape is adhered to the top of the container or finished web stock 20 by means of a pressure sensitive adhesive 29, and covers the pour hole 27.

It has been found that the top tape 28 would compromise the container's integrity if used alone. Essential oils in some fruit juices as well as high acid products or high solvent fills may attack the pressure sensitive adhesive thereby making the closure ineffective. For this reason, an interior tape or raw edge protection (REP) tape is utilized on the interior of the container. The REP tape may be a polyethylene film having a pressure sensitive adhesive 31 thereon for adhering to the finished stock 20.

As seen in FIG. 3, the two tapes 28 and 30 are pressed together in the pour hole 27 to thereby adhere to each other. Though such a system provides a more reliable closure of the pour hole 27, it is noted that the adhesive 31 may still be attacked by the contents of the container to thereby compromise the integrity thereof. Additionally, with the closure system is provided a third tape 32, such as a metalized polyester, which is adhered to the top tape 28 by an adhesive 33 forming a grip tab. During operation the grip tab 32 is pulled up by the consumer thereby breaking the adhesive seal of the top tape 28, and additionally breaking the REP tape 30 in the region of the pour hole 27 to expose the opening.

The process of adhering the suitable closure/opening mechanism over the die cut hole begins with application of the first tape 28 adhered to the top of the carton stock by means of an adhesive. At this point, or earlier in production, the grip tab tape 32 is applied to the top tape to provide an area for easy grasping and activation of the pull tab. The carton stock is then ready to proceed to the actual filling operation once the preformed opening is suitably sealed.

Figure 4:
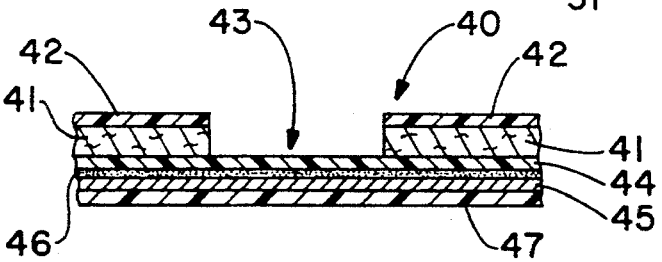
FIG. 4 is an enlarged cross-sectional view showing the modified multi-laminated structure of the container in the present invention.

It is the object of the present invention to provide a simplified pull tab system which overcomes the deficiencies of the prior art. Turning to FIG. 4, there is shown a modified carton stock to which a pull tab system is to be applied. The multi-laminated structure 40 includes a base paper stock 41 which is coated on the outer surface thereof by a layer of extruded polymeric material such as polyethylene 42. An initial preformed opening or pour hole 43 is then die cut through the layers 41 and 42. As will be seen hereinafter, the polyethylene layer 42 will be heated subsequent to forming the pour hole in the container to wet out layer 42 and seal the paper edges of base stock 41. Alternatively, the base paper stock 41 may first be provided with a die cut pour hole 43 and subsequently sealed on its outer surface with polyethylene layer 42, to thereby seal the edges of pour hole 43. In this manner, an uninterrupted top layer 42 will extend over pour hole 43 which will be subsequently heated during application of a pull tab to seal the paper edges of layer 41 and be adhered to uninterrupted barrier layers on the interior of the container. An uninterrupted layer of polymeric material such as polyethylene 44 is then extruded on the inner surface of the base paper stock 41 and over the die cut pour hole 43 to thereby seal the pour hole 43 from the inner surface of the container. An aluminum foil 45 is then laminated to the polyethylene layer 44 over the pour hole 43. A further layer of polymeric material such as polyethylene 47 may then be extruded over the aluminum foil 45 to form a non-interrupted multi-laminated barrier structure covering the pour hole from the inner surface and sealing all paper edges. The multi-laminated structure shown in FIG. 4 comprises the finished web stock for the cartons which is then slit to individual widths and utilized as roll stock material. The finished web stock is now ready to enter the first stage of the filling process. This process begins by adhering a suitable opening mechanism over the die cut hole that has been covered on the inner surface with the extruded polyethylene and aluminum foil layers. It is noted that this process could be performed off-line in front of the filler, but it is preferred to be an in-line process facilitating efficient manufacture.

Figure 5:
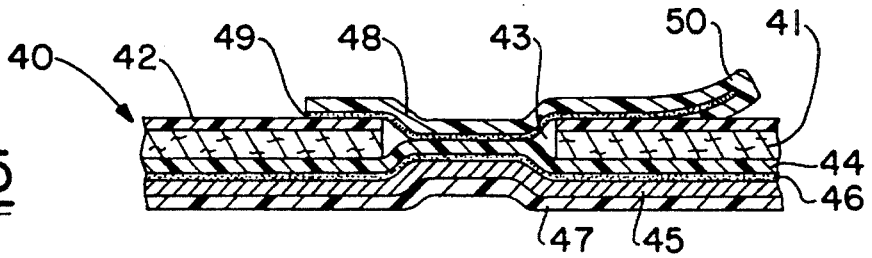
FIG. 5 is an enlarged cross-sectional view of the pull tab opening mechanism of the present invention taken along the line 5–5 of FIG. 1.

A particular opening mechanism is shown in FIG. 5 wherein the finished multi-laminated web stock 40 is shown. The base paper stock 41 sealed with polyethylene layer 42 and provided with the preformed opening or pour hole 43 is shown with the layers of polyethylene 44, aluminum foil 45 and polyethylene 47 covering the pour hole 43. The pull tab 48 includes a single tape, which may be a metalized polyester or similar material, which is adhered to the top layer of the polyethylene 42 and over the pour hole 43 by means of a suitable adhesive 49. As can be seen in the Figure, the adhesive along with the pull tab 48 drape into the die cut pour hole and pressed into and adhered to the polyethylene layer 44 covering the inner surface of the pour hole 43. The pull tab adhesive 49 is preferably a heat activated adhesive which has particular properties, but may be a pressure sensitive adhesive or a combination of the two. The adhesive utilized must provide sufficient bonding strength to rupture the layers of polyethylene 44, aluminum foil 45 and polyethylene 47. The pull tab 48 along with the bond between it and the lamination layers at the location of pour hole 43 must have enough integrity to rupture and pull out the series of laminations to form a clean opening at the pour hole 43. It has been found that a bonding strength of at least 750 grams per inch is necessary in this construction, but may vary depending on the particular materials and thickness of the layers. It is also desired that the adhesive be able to bond satisfactorily in a very quick manner. A heat activated adhesive has been found to be effective in this respect, but any adhesive with these properties is sufficient.

It is also an aspect of the invention that the uninterrupted layers of polyethylene 44, aluminum foil 45, and polyethylene 47 or similar aseptic barrier materials be provided on interior of the container to completely aseptically seal the container even at the location of pour hole 43. In such a construction, the problem of delamination between the aseptic barrier layers and/or the potential elongation of various of the aseptic barrier materials was found to provide distinct problems in the formation of a clean and functional pour hole upon activation of the pull tab opening mechanism. As described with reference to the preferred embodiment, a heat activated adhesive is used to bond pull tab 48 to the aseptic barrier layers 44, 45, and 47. In application of pull tab 48, heat and pressure are applied at the location of pour hole 43 and the polyethylene layers 44 and 47 will be melted and fused at the location of pour hole 43. In this manner, the pull tab 48 is also fused with this series of laminations, and the polyethylene layers 44 and 47 are weakened at the location of pour hole 43. Due to the adhesion and weakening of the aseptic barrier layers upon subsequent activation of the pull tab 48, the series of aseptic barrier material layers will be properly pulled out of pour hole 43 to leave a clean, nonobstructed pour hole. Similarly, as the polyethylene layers 44 and 47 have been weakened at the location of the pour hole 43, no substantial elongation of these material layers will occur. In the preferred embodiment, a heat activated adhesive is provided to bond the pull tab 48 to the laminations of aseptic barrier materials covering the interior of the container and pour hole 43. Heat is applied from both above and below the construction at the location of the pour hole, with heat application to the top of the construction in the range between 300° and 400° F. and a bottom heat application of between 150° and 300° F. The dwell time in which heat application is performed is in the range of 0.5 seconds to 1.5 seconds at the top and bottom of the construction with variations in the dwell time between top and bottom being possible. Pressure is also applied between the pull tab 48 and series of laminations covering the pour hole 43, such as a pressure of between 35 and 55 pounds per square inch at the location of pour hole 43. In this manner, although the aseptic characteristics of the barrier material layers 44, 45, and 47 or the like are maintained, the multi-laminated structure is weakened at the location of pour hole 43 to allow proper rupturing thereof upon activation of pull tab 48. The series of laminations 44, 45, and 47 are bonded with a bonding strength which is greater than the tensile strength of the plurality of laminations together so as to prevent delamination between the plurality of laminations. It should be recognized that as the thicknesses of the aseptic barrier material layers change, different bonding strengths may be necessary to enable rupture of the series of layers without delamination between layers occurring. As an alternative, the aseptic barrier material layers may be adhered to one another by a permanent adhesive having characteristics to prevent delamination between layers at the location of pour hole 43. Further, pressure may be applied at the location of pour hole 43 upon application of pull tab 48 to cause weakening of the series of layers which will result in proper functioning of the pull tab to make a clean and nonobstructed pour hole in the container upon activation of the pull tab.

In the preferred embodiment of the present invention, the apparatus comprises an upper die which will apply pressure and heat to the pull tab tape 48 to activate the adhesive 49 and firmly secure the tape 48 to the polyethylene layers 42 and 44. It is noted that heat applied by the die is also utilized to wet out the polyethylene layer 44 as quickly and efficiently as possible to give the proper adhesion characteristics. Both the lower and upper dies of the application apparatus will press the layers of polyethylene 44, aluminum foil 45 and polyethylene 47 into the die cut pour hole 43, so that the pull tab 48 and layers on the inner side of the pour hole 43 may be adhered to each other. The lower die is also heated to facilitate wetting out of the polyethylene layer 44. Both of the dies are shaped to extend around the preformed pour hole 43 in the area circumjacent thereto and are constructed of a silicone rubber or the like such that they will conform to the opening 43 and facilitate pressing of the laminations into the pour hole 43 to be adhered together and weakened. It is also possible to form the dies to the shape of the pour hole which acts to press the laminations together in the pour hole 43 but, it has been found that the previous structure described yields easier and faster manufacturing as the indexing of the dies is less critical than in the latter structure. Also, the pour holes themselves can be less precisely cut into the base paper stock as to their shape and placement due to the larger die size making their placement less critical.

It is seen by the opening system shown in FIG. 5, that the use of a second tape to be applied to the underside of the pull tab tape to act as a barrier is not necessary. It is also seen that the structure does not compromise the integrity of the carton stock as there is a completely uninterrupted film barrier of polyethylene/foil/polyethylene between the fill and the outside contamination. During activation of the pull tab, the three film barrier is ruptured due to the adhesion and weakening of the laminated barrier layers and the pull tab adhered thereto, thereby leaving a clean hole the same shape as the original pour hole cut in the base paper stock 41. It is also noted in FIG. 5, that the pull tab 48 is merely folded over at 40 resulting in an adhesive to adhesive bond and forming a grip tab used to operate the pull tab 48. Thus, the opening mechanism of the present invention is greatly simplified relative to a system shown in FIG. 3 for production, and also does not compromise the integrity of the resulting container. Once the pull tab opening mechanism is applied over the pour hole of the carton stock, the stock is then ready to proceed to the actual filling operation. All this can be done in an in-line process which does not restrict the filling of the containers by the filling apparatus.

Figure 7:
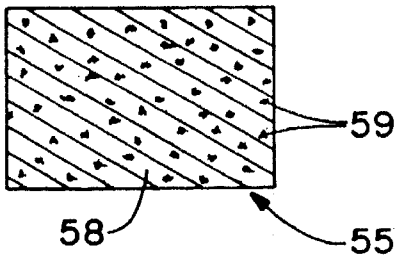
FIGS. 6 and 7 show enlarged bottom views of alternate embodiments of the pull tab of the present invention for providing the reclosable feature.
Figure 6:
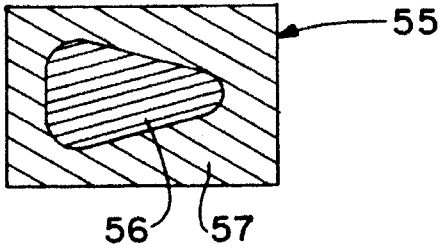

The pull tab opening mechanism of the present invention may be provided with a reclosability feature for temporary storing of an opened container. Such a feature is especially important in larger sized containers having more than one serving of the product contained therein. Referring to FIG. 6 and 7, the pull tab of the present invention is shown which comprises a metalized polyester or similar material having a suitable adhesive on the bottom side thereof. As described in relation to FIG. 5, the pull tab is provided with a heat activated adhesive which suitably adheres to a top layer of polyethylene circumjacent the pour hole and to the layer of polyethylene coating the inner surface of the container and covering the pour hole. The pull tab provides the desired peel strength to rupture the three film barrier over the die cut pour hole of the container. It is noted that after initial bonding of the pull tab by heat activation, any reclosability feature must be performed by a pressure sensitive adhesive.

In FIG. 6, a pull tab 55 is provided with a plurality of adhesives which have been pattern coated onto the bottom side thereof. The heat activated adhesive 56 as previously described is disposed in the area of the pour hole of the container and of such dimensions as to completely adhere over the pour hole. Elsewhere on the pull tab 55 is provided a pressure sensitive adhesive 57 which is initially bonded to the area circumjacent to the pour hole of the container. After operation of the pull tab resulting in rupture of the three film barrier over the pour hole of the container, the pressure sensitive adhesive 57 will enable temporary reclosing of the pull tab over the opened pour hole in the container.

Alternatively, as shown in FIG. 7, the pull tab 55 may be provided on its entire bottom surface with a heat activated adhesive 58 as previously described in relation to FIG. 5. A pressure sensitive adhesive 59 may then be dispersed over the bottom of the pull tab 55 to enable reclosing of the pull tab after initial operation. The embodiment as shown in FIG. 7 would avoid the extra cost of pattern coating the pull tab, and would still enable the pull tab to be temporarily reclosed. Tampering with such containers has been a recent problem, but it is noted that because of the initially uninterrupted film barrier between the fill product and the pull tab, any tampering will be evident while still gaining the advantages of the reclosability feature.

Figure 8:
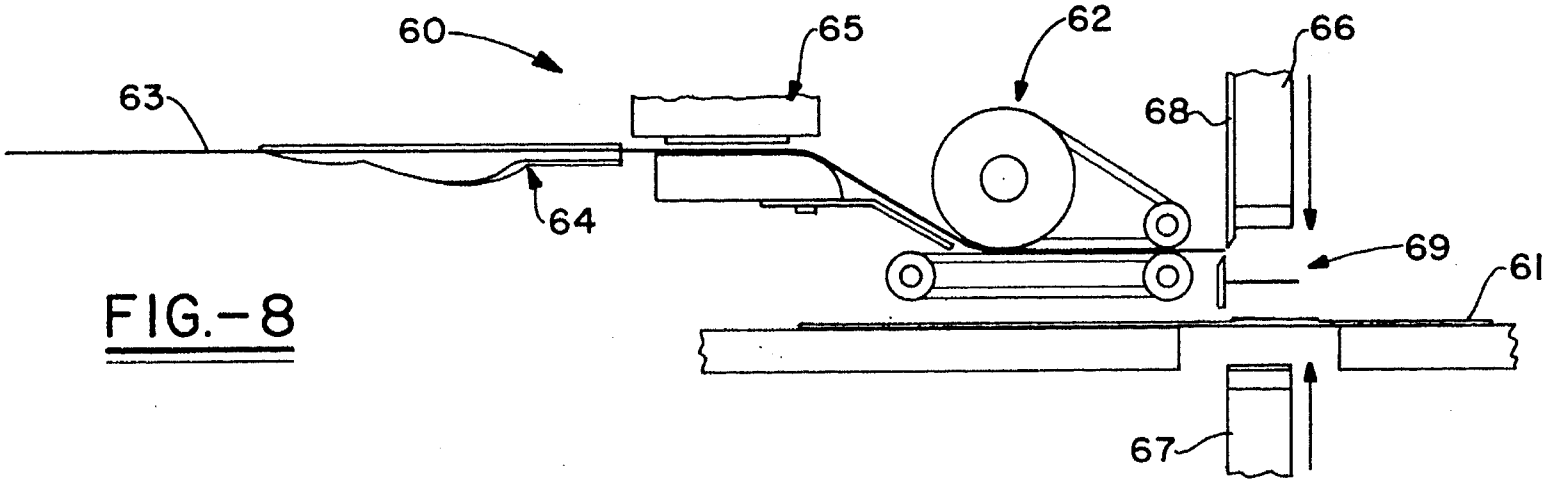
FIG. 8 is a side view of the apparatus utilized in applying the pull tab of the present invention.

Turning now to FIG. 8, the apparatus utilized to apply the pull tab of the present invention is more particularly shown. The apparatus generally designated 60, which operates in-line with an aseptic filling apparatus (not shown) including the finished web stock 61 as shown in FIG. 4 as 40. The web stock 61 is roll fed to an aseptic filling apparatus with the pull tab applied to the carton stock before actual filling. The applicator apparatus 60 comprises an indexing drive assembly 62 which feeds the pull tab material 63 through a folding mechanism 64 and a heat laminating die 65. The pull tab material 63 comprises a metalized polyester or similar material with a heat activated or pressure sensitive adhesive disposed on one side thereof as previously described. The folding mechanism 64 produces a folded edge which is then creased and heated by heating die 65 to form a laminated folded edge in the pull tab material.

In operation, the indexing drive assembly 62 feeds the pull tab material 63 with the folded edge to a pair of application dies 66 and 67, which include cutting means 68. A suitable length of the pull tab material 63 is cut and pressed by upper die 66 onto the carton stock material 61. The upper and lower dies are flat and have dimensions greater than the preformed pour hole 43 as shown in FIG. 4. The dies 66 and 67 are constructed of a silicone rubber or similar material which has the characteristics of being conformable into the preformed pour hole 43. The dies may be coated with a teflon or similar coating to provide low surface energy die structures, so that the laminations may be pushed into the preformed pour hole as described in relation to FIG. 5. Both the upper dies 66 and lower dies 67 provide the necessary pressure and heat to activate the adhesive on the pull tab material and wet out the polyethylene laminations of the finished stock material as previously described. For example, the application of the pull tab by such a die structure can be carried out by applying a pressure of 30 p.s.i. and a temperature of 350 degrees F. for the upper die 66 and a temperature of 200° F. for the lower die 67 for one second. Such application parameters will vary according to the specific materials used and other variables, but in any event will be commensurate with other equipment in the production line. It can be seen that the lamination of the pull tab material to the finished carton stock in the manner associated with FIG. 5, is easily accomplished and provides the desired opening mechanism to the container along the filling production line.

Figure 9:
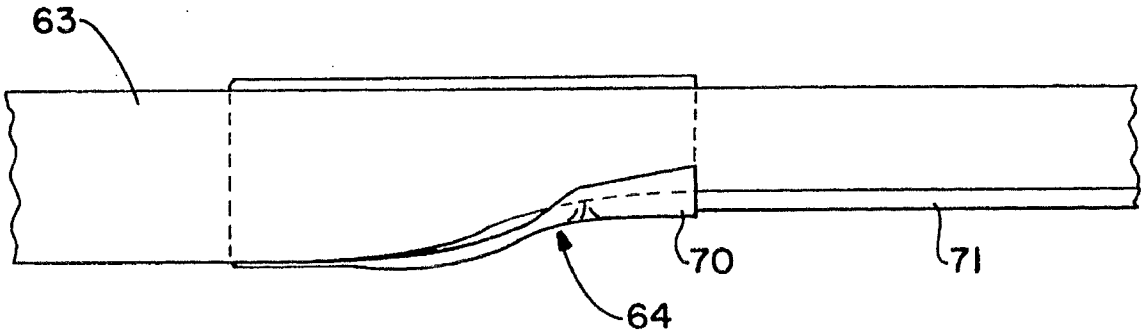
FIG. 9 is a bottom view of the apparatus utilized to produce a grip tab on the pull tab mechanism.

The folding mechanism 64 is more particularly shown in FIG. 9, wherein the pull tab material 63 is fed to folding mechanism 64 having bracket 70 to lift and fold an edge of the pull tab material 63, and thereby form a folded edge 71 in the pull tab material. Such a system obviates the necessity of having an additional tape adhered to the pull tab for gripping as in the prior art.

It can readily be seen that the objects of the present invention are obtained with the structure of the opening mechanism described along with the method and apparatus for its application. The present invention achieves the desired results of an easy opening pull tab feature without compromising the integrity of the container in a simplified and cost effective manner. While the preferred embodiment of the present invention have been disclosed herein, it will be appreciated that modification of these particular embodiments of the invention may be resorted to without departing from the scope of the invention as found in the appended claims.

What is claimed is:

1. An aseptic container opening assembly comprising:

a container having a base stock with interior and exterior surfaces, said base stock having a preformed pour opening in one end thereof;

a plurality of layers of barrier material disposed on the entire interior surface of said container and extending over said pour opening, said layers being constructed of aseptic barrier materials and comprising at least a first uninterrupted layer of polymeric material on said interior surface of said container, and an uninterrupted foil layer, each of said plurality of layers being bonded together with a bonding strength which prevents delamination between said plurality of layers, said plurality of layers providing aseptic characteristics to said container;

a tape disposed over said pour opening and an area of said exterior surface surrounding said pour opening, said tape being pressed together with heat and pressure applied to said plurality of layers at the location of said pour opening without effecting delamination of the plurality of layers at the location of the pour opening resulting in said tape being bonded to said first layer of polymeric material with a bonding strength greater than the tensile strength at said location of said plurality of layers together, wherein said tape forms a pull tab enabling rupture of said plurality of layers without delamination between said layers adjacent to and across said pour opening upon activation of said pull tab to expose said pour opening.

2. A container opening assembly as in claim 1, wherein;

said tape is adhered to said first layer of polymeric material by a heat activated adhesive, and upon the application of heat to bond said tape to said first layer of polymeric material, said at least first layer of polymeric material is melted and fused to said foil layer.

3. A container opening assembly as in claim 1, wherein;

said tape is adhered to said first layer of polymeric material by a heat activated adhesive provided in the area of said pour opening, and a pressure sensitive adhesive in the area circumjacent to said pour opening, wherein said pressure sensitive adhesive enables said tape to be selectively released and adhered to the exterior surface of said base stock to allow said pour hole to be selectively reclosed.

4. A container opening assembly as in claim 3, wherein;

said heat activated and pressure sensitive adhesives are pattern coated on said pull tab.

5. A container opening assembly as in claim 1, wherein;

said tape is adhered to said first layer of polymeric material by a heat activated adhesive coating on a side of said tape, and having a pressure sensitive adhesive dispersed thereover to allow the pull tab to be selectively re-adhered to said exterior surface for reclosing of said pour hole.

6. A container opening assembly as in claim 1, wherein;

said plurality of layers further include a second layer of polymeric material and each of said layers is uninterrupted and cover all interior surfaces of said container, with said first and second polymeric material layers being melted into bonding relationship with adjacent of said layers and said tape upon the application of heat when said tape is applied over said pour hole so as to provide said bonding strength at the location of said pour hole.

7. A container opening assembly as described in claim 1, wherein;

said exterior tape has one edge thereof folded over and bonded to itself to form a grasping area for said pull tab.

* * * * *